United States Patent [19]

Paul

[11] 4,029,021

[45] June 14, 1977

[54] COIL AND PNEUMATIC SPRING ASSEMBLY

[75] Inventor: John M. Paul, Holland, Pa.

[73] Assignee: The Budd Company, Troy, Mich.

[22] Filed: Dec. 24, 1975

[21] Appl. No.: 644,274

[52] U.S. Cl. ..... 105/199 R; 105/197 B; 267/3

[51] Int. Cl.[2] ..... B61F 5/06; B61F 5/10; B61F 5/14; B61F 5/50

[58] Field of Search ..... 105/182 R, 197 B, 366 B, 105/199 R; 267/3, 4

[56] References Cited

UNITED STATES PATENTS

| | | | |
|---|---|---|---|
| 2,908,230 | 10/1959 | Dean | 105/182 R |
| 3,020,856 | 2/1962 | Hirst | 105/197 B |
| 3,491,702 | 1/1970 | Dean | 105/197 B X |
| 3,491,703 | 1/1930 | Austgen | 105/366 B |
| 3,712,245 | 1/1973 | Lich | 105/197 B X |

*Primary Examiner*—Robert J. Spar
*Assistant Examiner*—Howard Beltran

[57] ABSTRACT

A railway car suspension which includes a coil and pneumatic spring arrangement wherein the pneumatic spring means is disposed lowermost on a truck frame to absorb vertical jolts and absorption of lateral loads, together with stabilizing means between the upper end of the pneumatic spring means and the spring supporting body; and in which the coil spring means is disposed uppermost and arranged to take full loading in case of failure of the pneumatic spring means.

1 Claim, 4 Drawing Figures

COIL AND PNEUMATIC SPRING ASSEMBLY

BACKGROUND

In U.S. Pat. No. 3,491,702 A. G. Dean, Jan. 27, 1970, there is disclosed a spring support arrangement for railway vehicles in which pneumatic and coil spring means are arranged in series, with the coil spring disposed lowermost and the pneumatic spring means disposed uppermost, together with lateral stabilizing means between the lower end of the pneumatic spring means and the supported body.

The arrangement of the patent has had very extensive use on railway vehicles and has furnished great improvement over prior arrangements, i.e. it has given better ride characteristics than had previously been attained with coil springs alone or with pneumatic springs alone or with any previously suggested combination of coil and pneumatic springs. Reference may be made to the patent for discussion of various performance characteristics of coil and pneumatic springs and prior suggested combinations of coil and pneumatic springs.

SYNOPSIS OF INVENTION

When the coil springs are arranged lowermost, seated on the truck bolster as in the patent, undesirable jolts or impacts, referred to as "hat bounce", are transmitted and the pneumatic springs which are arranged uppermost do not fully absorb the transmitted shocks so that they cause undesirable effects in the vehicle body.

According to the present invention, it has been found that when the pneumatic spring element of the series combination spring is placed lowermost, on the truck bolster, most of the jolts or shocks are absorbed and do not reach the vehicle body nearly so much as with the prior reverse arrangement. Moreover, there is much better control of lateral deflections because the pneumatic spring base is broader and has better inherent characteristics in this direction than coil springs. Additionally, by having a lateral stabilizer connection between the upper end of the pneumatic spring means and the supporting body, truck bolster, instead of between the lower end of the pneumatic spring means and the supported body bolster, a better lateral stabilizing effect is obtained.

In extensive tests it has been demonstrated that the present arrangement actually does provide very considerable improvement in ride characteristics in the areas under consideration.

DRAWINGS

The objects of the invention, as well as various features of novelty and advantages, will be apparent from the following description of an exemplary embodiment shown in the accompanying drawings, wherein.

SPECIFIC EMBODIMENT

Figure 1:
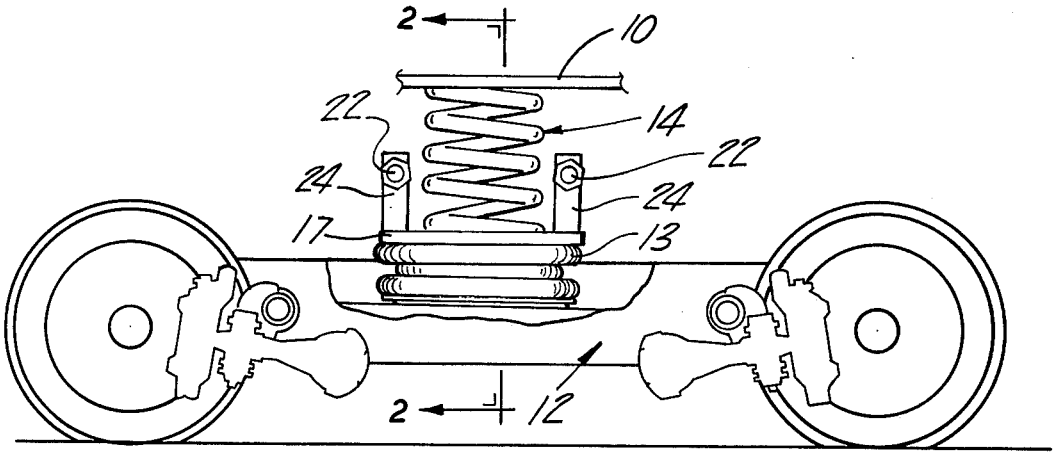
FIG. 1 is a side elevation, with parts broken away, of a single unit of the combination coil-pneumatic spring arrangement installed between the truck bolster and body bolster of a railway vehicle.
Figure 2:
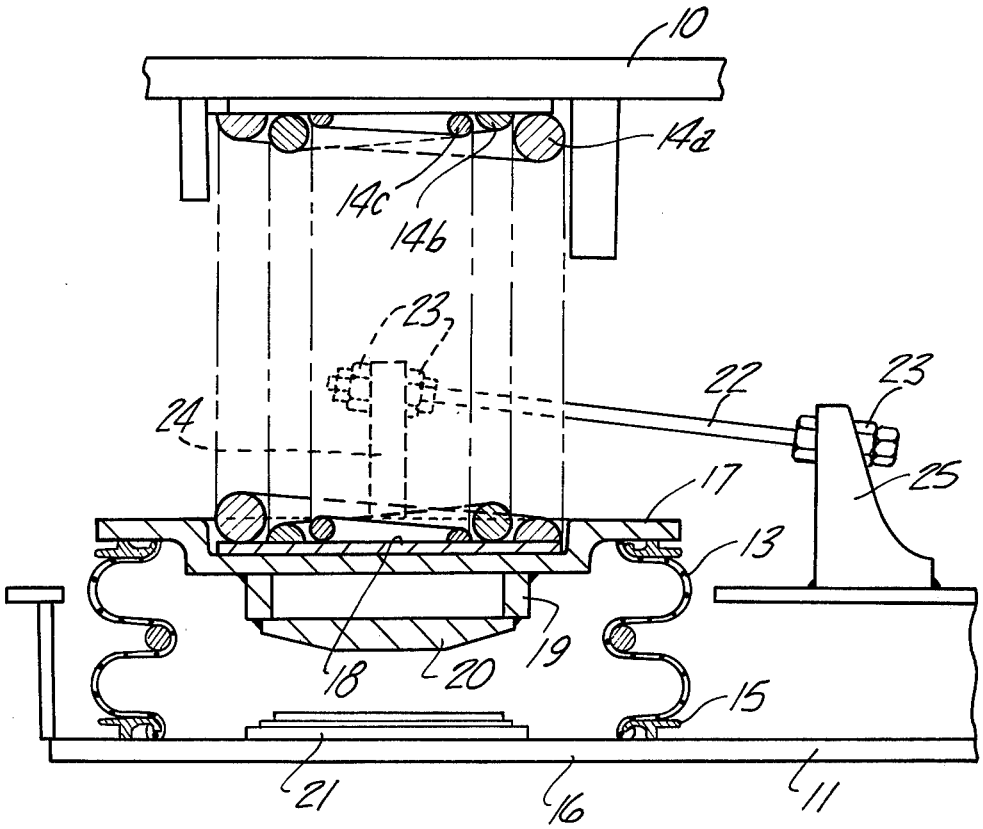
FIG. 2 is an enlarged transverse vertical section of the spring unit alone, the view being taken on the line 2—2 of FIG. 1, and FIGS. 3 and 4 represent charts including output signals resulting from various tests conducted to illustrate some of the advantages of the present invention.

The single combination spring unit disclosed herein is arranged between a car body underframe member or bolster 10 and a bolster 11 of a truck 12. The truck may be of the general type as that shown in U.S. Pat. No. 2,908,230, W. B. Dean, Oct. 13, 1959.

The combination spring unit comprises pneumatic spring means 13 of the bellows type and structural spring means 14 of the coil type, here including a nest having an outer coil **14*a*, an intermediate coil 14*b*, and an inner coil 14*c***, the coils being of increasing strength from inner to outer.

The pneumatic spring means is disposed lowermost, as on a pad 15 secured on the truck bolster and having a controlled fluid supply means, here generally indicated by a threaded opening in the base designated by the numeral 16.

The upper end of the pneumatic spring 13 carries a top-recessed cap 17 having a plate 18 on which the nest of coil springs 14 is seated. The cap 17 forms an intermediate member between the pneumatic spring means and the coil spring means.

The cap 17 has a lower annular projection 19 carrying a bumper pad 20 adapted to strike a stop member 21 on the truck bolster in case of failure of the pneumatic spring.

Means are provided for limiting the transverse lateral movement of the upper end of the pneumatic spring means relative to the truck bolster, the means here shown comprising transverse stabilizer rods 22 connected for swinging movement at one end through resilient elastic elements 23 with projections 24 carried by the intermediate cap plate 17 and connected for swinging movement at the other end through resilient elements 23 with projections 25 carried by the truck bolster 11.

The pneumatic spring means by being disposed lowermost and having stabilizer connections with the truck bolster is more effective for controlling lateral deflections than if placed uppermost and connected by stabilizers with the car bolster. The dual stabilizer connection improves the effect.

Also, by being disposed lowermost the pneumatic spring means is more effective for absorbing jolts than if placed uppermost. By being placed uppermost the coil springs have less objectionable effects, both as to jolts and lateral movements, than if placed lowermost.

In general, the ride comfort or discomfort for a passenger in a car is dependent upon abrupt movements or changes in the acceleration of the car in vertical, lateral and longitudinal directions. These changes may be considered as having direction, amplitude and frequency. With greater changes in amplitude and higher frequencies, the riding discomfort for the average passenger tends to increase.

In evaluating the present invention, testing of a car incorporating the spring arrangement illustrated in this application was compared with a similar type car incorporating the spring arrangement illustrated in the U.S. Pat. No. 3,491,702. Tests of the cars with the two different spring arrangements were conducted. Both cars travelled the same distances on comparable tracks on the same day at speeds of about 60 miles per hour.

Figure 3:
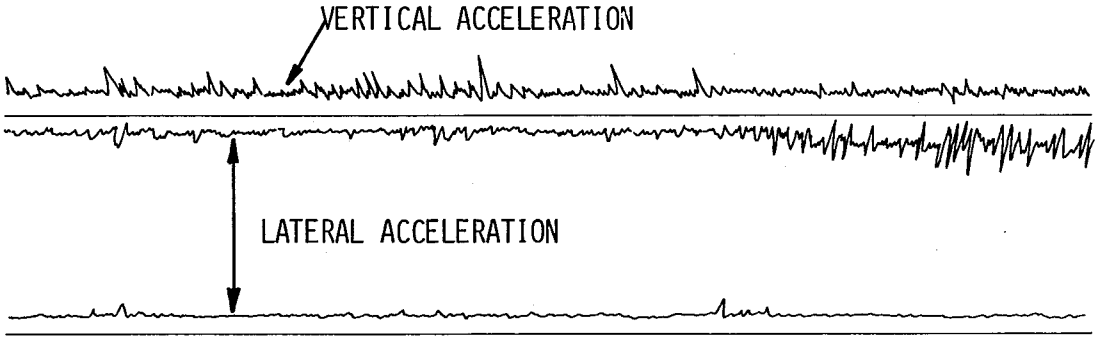
Figure 4:
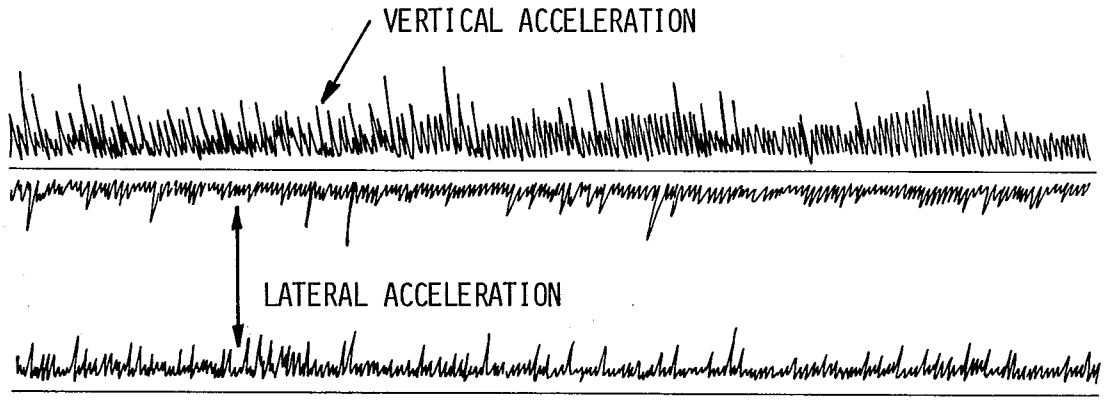

FIG. 3 is a chart illustrating output signals from a pen recorder responsive to vertical and lateral accelerations of the car incorporating the spring arrangement described in the present application. FIG. 4 is a chart illustrating similar type signals with the car incorporating the spring arrangement of U.S. Pat. No. 3,491,702. FIGS. 3 and 4 represent comparable small portions of total readings during the tests. In general, higher frequencies and greater amplitudes result in greater ride discomfort. The following tables represent readings taken during the entire tests.

RIDE QUALITY

| Vertical Accel. (g) | Weight Factor | Disclosure Count | Pat. 3,491,703 Count | Disclosure Index | Pat. 3,491,703 Index |
|---|---|---|---|---|---|
| .00–.07 | 1.0 | 417 | 97 | 417.0 | 97.0 |
| .07–.12 | 2.94 | 126 | 196 | 370.4 | 576.2 |
| .12–.17 | 5.90 | 17 | 256 | 100.3 | 1510.4 |
| .17–.22 | 9.88 | 2 | 141 | 19.8 | 1393.1 |
| .22–.27 | 14.88 | 0 | 46 | 0 | 684.5 |
| .27–.32 | 20.90 | 0 | 11 | 0 | 220.9 |
| .32 4 .37 | 27.94 | 0 | 0 | 0 | 0 |
| .37–.42 | 36.0 | 0 | 0 | 0 | 0 |
| .42–.47 | 45.08 | 0 | 0 | 0 | 0 |
| .47–.52 | 55.18 | 0 | 0 | 0 | 0 |
| | | | | 907.5 | 4482.1 |

| Lateral Accel. (g) | Weight Factor | Disclosure Count | Pat. 3,491,703 Count | Disclosure Index | Pat. 3,491,703 Index |
|---|---|---|---|---|---|
| .00–.04 | 1.0 | 493 | 547 | 493.0 | 547.0 |
| .04–.07 | 3.06 | 84 | 320 | 257.0 | 979.0 |
| .07–.10 | 6.25 | 31 | 144 | 193.8 | 900.0 |
| .10–.14 | 12.25 | 8 | 47 | 98.0 | 575.8 |
| .14–.17 | 18.06 | 1 | 17 | 18.1 | 307.0 |
| .17–.21 | 27.56 | 2 | 6 | 55.1 | 165.4 |
| .21–.25 | 39.06 | 0 | 1 | 0 | 39.1 |
| .25–.28 | 49.0 | 0 | 0 | 0 | 0 |
| .28–.32 | 64.0 | 0 | 0 | 0 | 0 |
| | | | | 1115.0 | 3513.5 |

The columns "Vertical Acceleration" and "Lateral Acceleration" represent g or gravity readings. "Weight Factor" is a factor representative of the degree of discomfort produced by movements of the car through the distances involved. For example, greater distances of movements tend to cause greater than just proportionally greater discomfort. This factor is somewhat subjective and, while it is considered by those in the industry, no precise standards have been established. The columns entitled "Disclosure Count" and "U.S. Pat. No. 3,491,702 Count" are the number of cycles in which the g's moved fell within the ranges listed in the vertical and lateral acceleration columns.

It may be seen from FIGS. 3 and 4 that the frequencies and amplitudes of the accelerations involved for the spring arrangement of the present invention are substantially greater than those involving the spring arrangement of the aforementioned patent.

What is claimed is:

1. Spring means for supporting a vehicle body on a truck bolster, comprising in combination, pneumatic spring means carried by the truck bolster, an intermediate plate with projecting anchor means disposed on the upper end of both sides of said pneumatic spring means, coil spring means carried upon said intermediate plate and supporting a vehicle body, and transverse lateral stabilizing means between the truck bolster and the anchor means of said pneumatic spring means.

* * * * *